US008397915B2

(12) United States Patent
Davidson

(10) Patent No.: US 8,397,915 B2
(45) Date of Patent: Mar. 19, 2013

(54) RIGID CASE WITH INTEGRATED PET WASTE BAG DISPENSER, STORAGE SYSTEM AND ACCESSORIES STORAGE

(76) Inventor: Susan Davidson, Santa Barbara, CA (US)

( * ) Notice: Subject to any disclaimer, the term of this patent is extended or adjusted under 35 U.S.C. 154(b) by 306 days.

(21) Appl. No.: 12/959,255

(22) Filed: Dec. 2, 2010

(65) Prior Publication Data

US 2011/0132269 A1 Jun. 9, 2011

Related U.S. Application Data

(60) Provisional application No. 61/283,508, filed on Dec. 3, 2009.

(51) Int. Cl.
*B65D 69/00* (2006.01)

(52) U.S. Cl. ..... 206/581; 206/229; 206/457; 119/161

(58) Field of Classification Search ..... 206/229, 206/575, 579, 457, 581, 389, 408; 119/161; 132/286, 315, 314, 312; 224/269, 666
See application file for complete search history.

(56) References Cited

U.S. PATENT DOCUMENTS

| | | | | |
|---|---|---|---|---|
| 1,501,525 | A * | 7/1924 | Croswhite | 132/295 |
| 1,684,417 | A * | 9/1928 | Silberman | 206/229 |
| 5,090,063 | A * | 2/1992 | Edwards et al. | 4/239 |
| 5,233,942 | A | 8/1993 | Cooper et al. | |
| 5,476,296 | A | 12/1995 | Gross | |
| 5,560,321 | A | 10/1996 | Hess | |
| D388,250 | S | 12/1997 | Robinson et al. | |
| 5,718,192 | A | 2/1998 | Sebastian | |
| 6,059,332 | A | 5/2000 | Beascoechea Inchaurraga | |
| 6,085,695 | A | 7/2000 | Miller et al. | |
| 6,135,276 | A * | 10/2000 | French et al. | 206/225 |
| 6,170,651 | B1 * | 1/2001 | Taormina | 206/5 |
| D439,040 | S | 3/2001 | Vazquez | |
| 6,199,737 | B1 | 3/2001 | Ringelstetter | |
| 6,237,533 | B1 | 5/2001 | Rodriguez | |
| 6,257,473 | B1 | 7/2001 | Ringelstetter | |
| 6,314,917 | B1 | 11/2001 | Ryan | |
| 6,418,881 | B1 | 7/2002 | Starratt | |
| D490,238 | S | 5/2004 | Bristel | |
| 7,073,462 | B1 | 7/2006 | Layman | |
| 7,090,268 | B2 | 8/2006 | Borman | |
| 8,220,625 | B2 * | 7/2012 | Michaels et al. | 206/233 |
| 2003/0037390 | A1 * | 2/2003 | Leblanc | 15/121 |
| 2007/0199518 | A1 | 8/2007 | Siemer | |

OTHER PUBLICATIONS http://www.poopod.com/poopod downloaded Dec. 2, 2010.

* cited by examiner

*Primary Examiner* — David Fidei
(74) *Attorney, Agent, or Firm* — Felix L. Fischer

(57) ABSTRACT

A pet waste disposal system incorporates a rear molding having an interior volume for a rear compartment and includes a bag roll containment chamber moiety adjacent an aperture in a bottom wall. A center molding has an extrusion received in a circumferential lip of the rear molding in a closed position and provides a center wall. The center molding also includes a bag roll containment chamber mating moiety extending from the center wall for engagement of the bag roll containment chamber moiety of the rear molding in the closed position. The extrusion houses a second interior volume for a portion of a forward compartment. A front molding has a sealing surface to engage a front sealing surface on the center molding. The front molding is closely received against the center molding in a closed position opposite the rear molding. A first closure element releasably secures the rear molding and center molding in the closed position and a second closure element releasably secures the center molding and front molding in the closed position.

20 Claims, 16 Drawing Sheets

RIGID CASE WITH INTEGRATED PET WASTE BAG DISPENSER, STORAGE SYSTEM AND ACCESSORIES STORAGE

REFERENCE TO RELATED APPLICATIONS

This application claims priority of U.S. provisional application Ser. No. 61/283,508 filed on Dec. 3, 2009 entitled Rigid Case to Carry Dog Waste the disclosure of which is incorporated fully herein by reference.

BACKGROUND INFORMATION

1. Field

Embodiments of the disclosure relate generally to the pet waste removal and more particularly to embodiments for an integrated rigid case providing separated compartments for waste hag dispensing, filled waste bag storage, personal item storage and deodorizing filtration system.

2. Background

Exercise for pets, particularly in urban environments, typically requires that owners take the pet "for a walk". Often this is only possible on public streets or pathways. Pet waste, particularly dog waste when walking the dog in public areas, must be collected and removed for public convenience and often is required under municipal ordinances. Most owners have been forced to carry loose plastic bags in pockets or purses to accomplish this task. While some walking locations and dog parks have disposal facilities in which bags filled with waste may be placed, generally, the pet owner must carry the waste filled bag home for disposal at the conclusion of the walk.

It is therefore desirable to provide a convenient dispenser for plastic bags for collecting waste to be carried on walks. Additionally, it is desirable that such a device accommodate storage of waste bags when filled. It is also desirable to provide convenient storage for personal items such as keys, cell phones, identification, cash that are also carried on the walk thereby precluding the requirement for carrying a separate wallet or purse.

SUMMARY

Exemplary embodiments provide a pet waste disposal system which incorporates a rear molding having an interior volume for a rear compartment and includes a bag roll containment chamber moiety adjacent an aperture in a bottom wall. A center molding has an extrusion received in a circumferential lip of the rear molding in a closed position and provides a center wall. The center molding also includes a bag roll containment chamber mating moiety extending from the center wall for engagement of the bag roll containment chamber moiety of the rear molding in the closed position. The extrusion houses a second interior volume for a portion of a forward compartment. A front molding has a sealing surface to engage a front sealing surface on the center molding. The front molding is closely received against the center molding in a closed position opposite the rear molding. A first closure element releasably secures the rear molding and center molding in the closed position and a second closure element releasably secures the center molding and front molding in the closed position.

The features, functions, and advantages that have been discussed can be achieved independently in various embodiments of the present invention or may be combined in yet other embodiments farther details of which can be seen with reference to the following description and drawings

DETAILED DESCRIPTION

Figure 1:
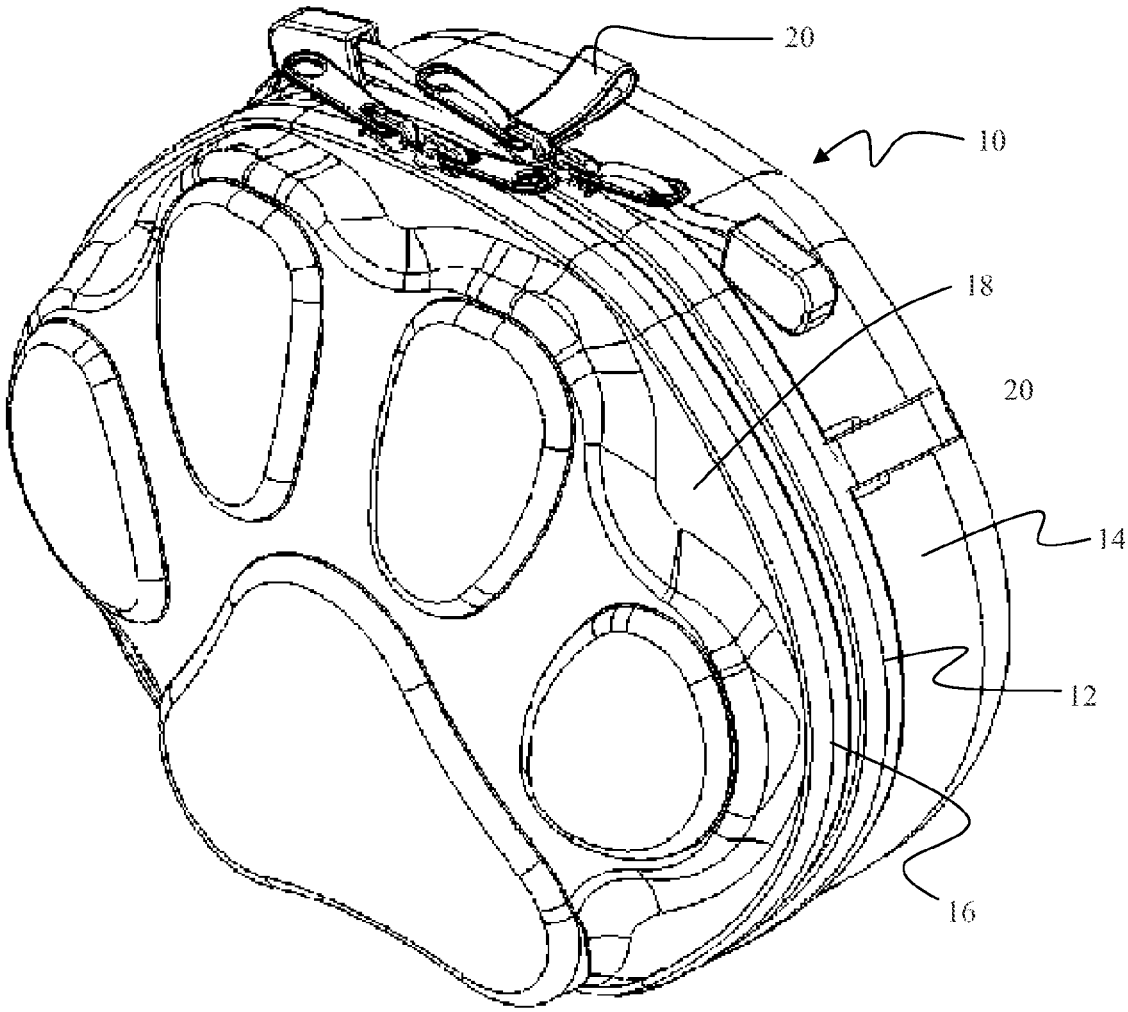
FIG. 1 is an upper front isometric view of an exemplary embodiment in the fully zippered closed condition.
Figure 2:
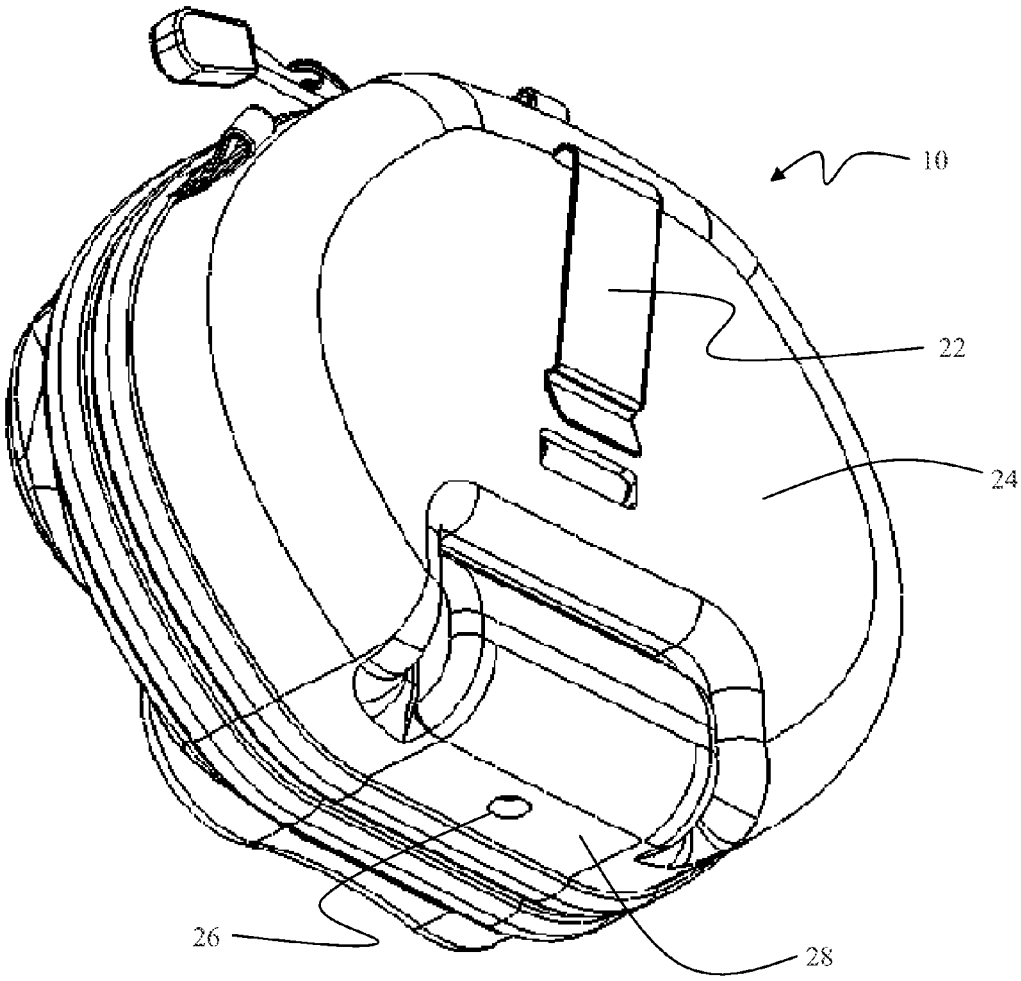
FIG. 2 is a lower rear isometric view of the embodiment of FIG. 1.
Figure 3:
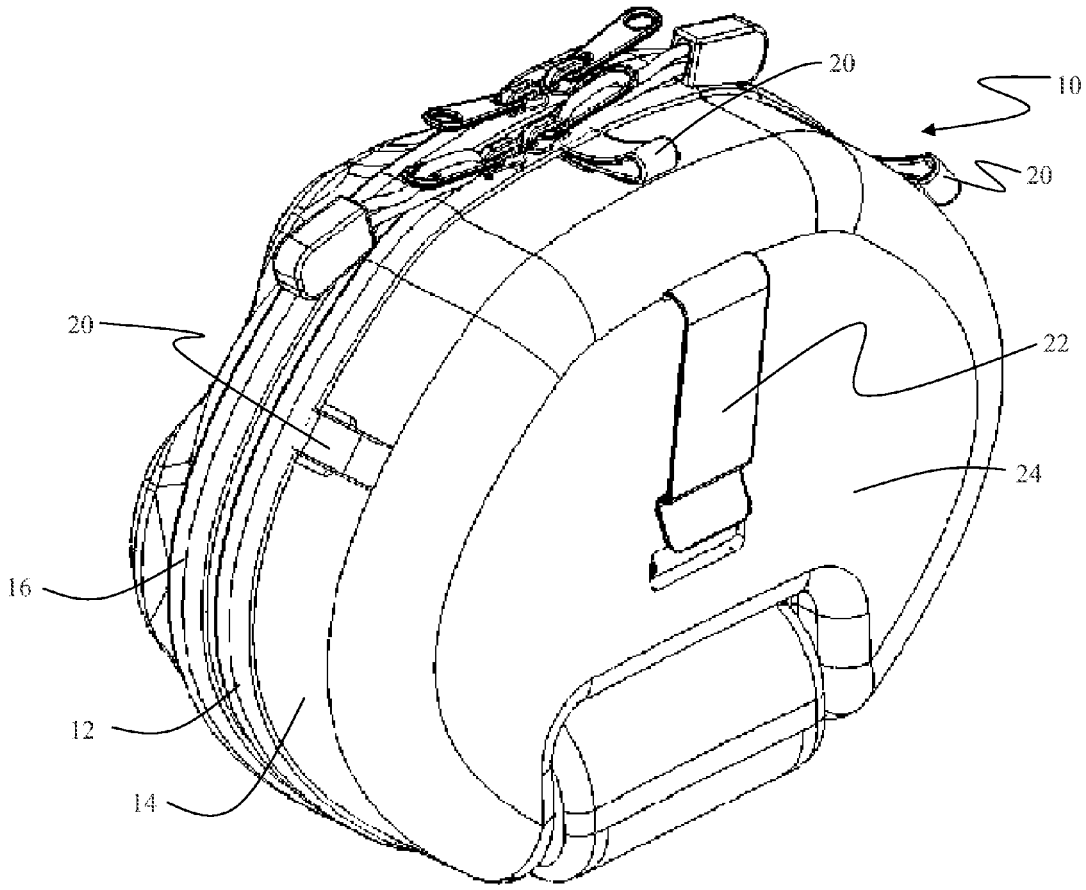
FIG. 3 is an upper rear isometric view of the embodiment of FIG. 1.
Figure 4:
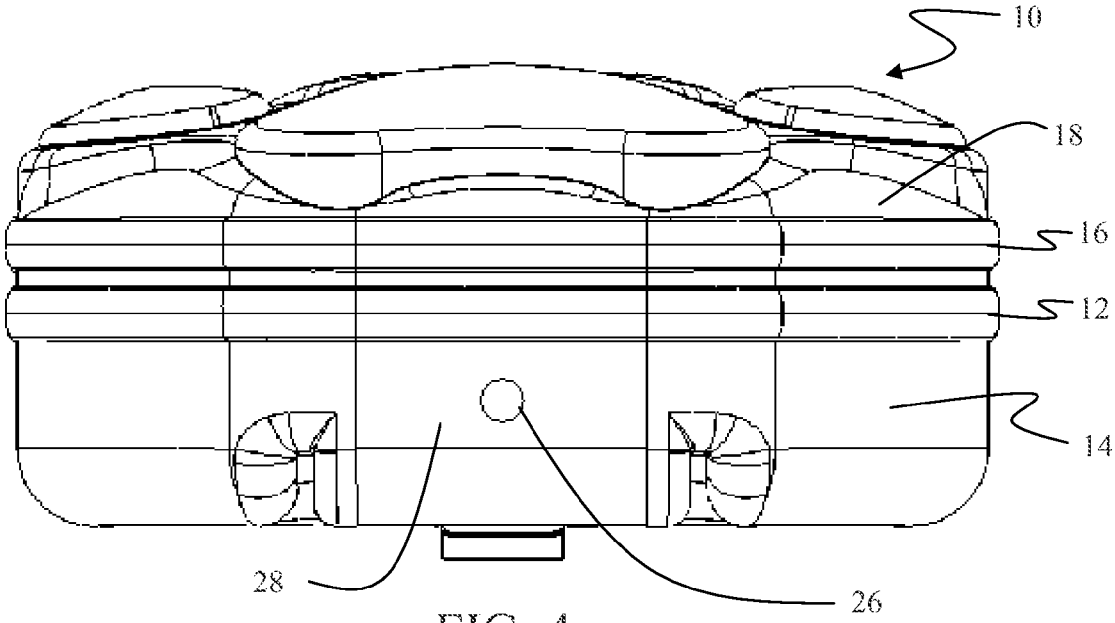
FIG. 4 is a bottom view of the embodiment of FIG. 1.
Figure 5:
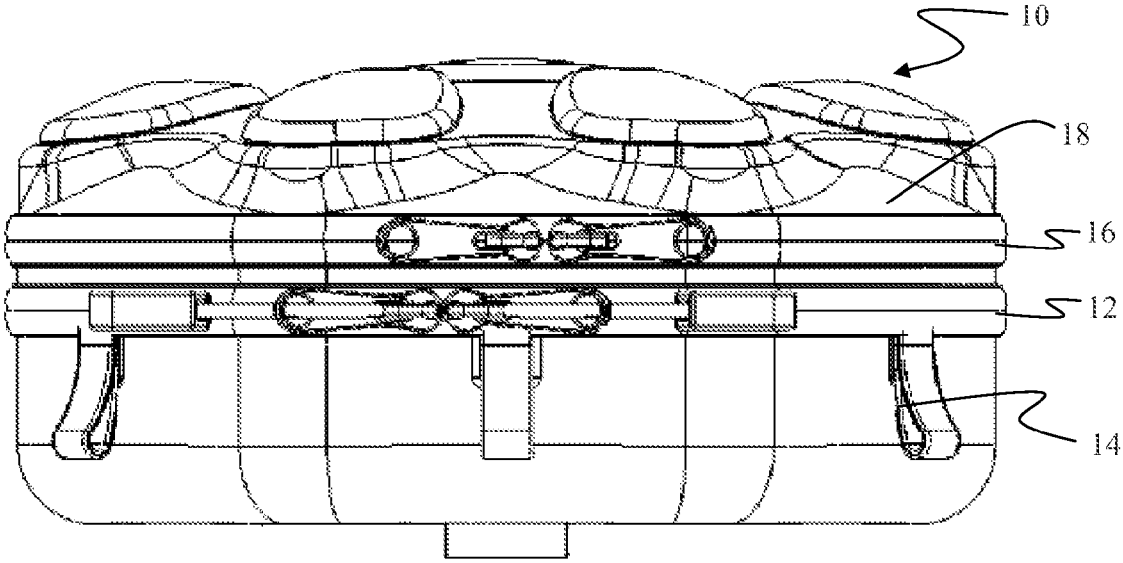
FIG. 5 is a top view of the embodiment of FIG. 1.
Figure 6:
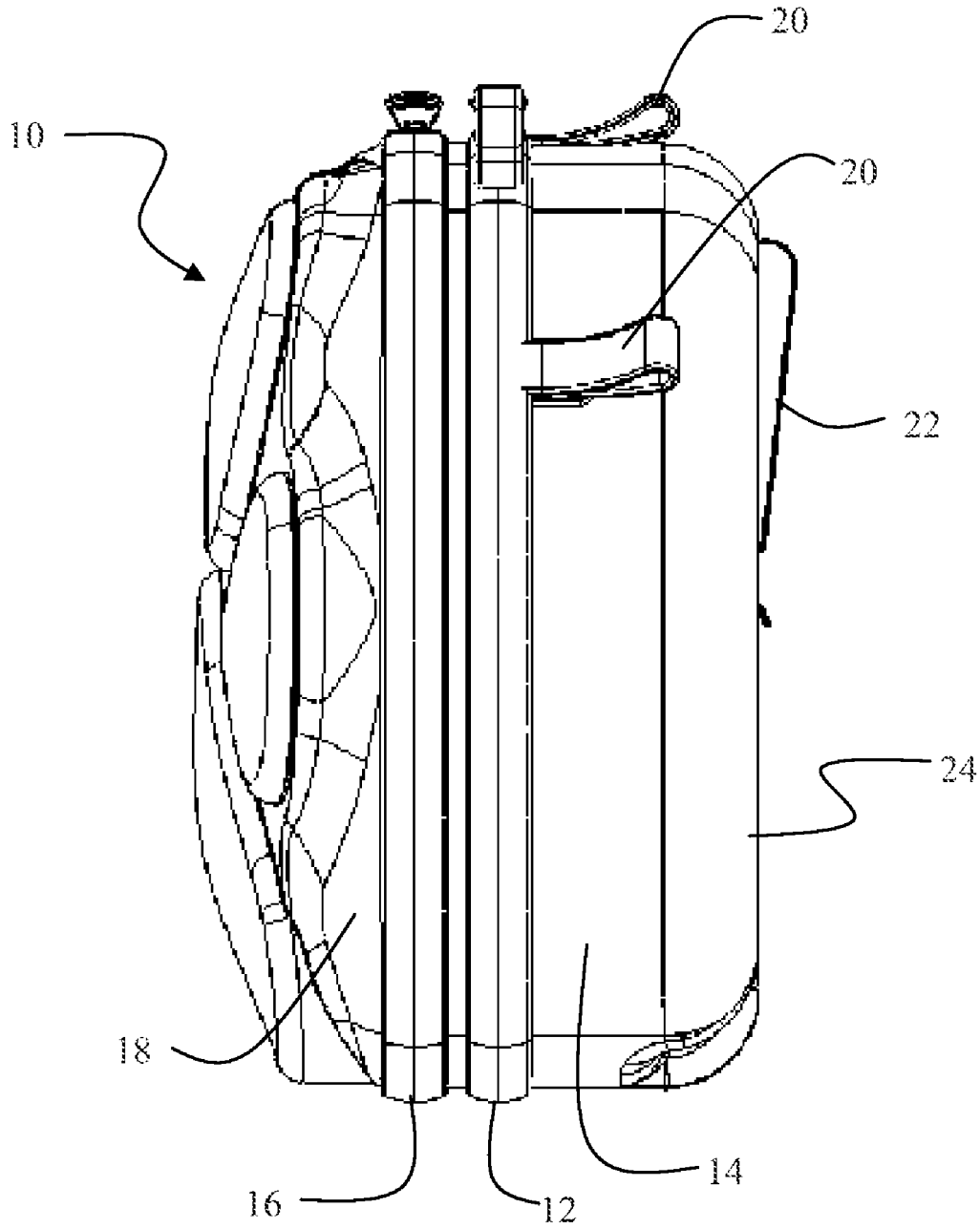
FIG. 6 is a side view of the embodiment of FIG. 1.

The embodiments described herein disclose a rigid case having multiple segregated internal compartments for storing and dispensing new pet waste collection bags, personal items and used bags containing waste with convenient compartment entry and closure as well as multiple carrying options. The rigid foam from which the case is formed provides surfaces which resist bacterial absorption or odor permeation and are easily cleaned with soap and water. Referring to the drawings, FIGS. 1-6 provide various views of the rigid case 10 with a first closing element, zipper 12, for securing a rear compartment 14 and a second closing element, zipper 16, for securing a front compartment 18. The configuration and interrelationship of the compartments will be described in greater detail subsequently. Carrying strap attachments 20 are arranged on the exterior of the case to receive shoulder or wrist straps for conveniently carrying the case. For the embodiment shown, the case is fabric covered and the strap attachments and zippers are sewn into the fabric or the molded elements of the case or both. Additionally, as shown in FIGS. 2 and 3, a belt clip 22 engages an external surface 24 of a rear wall for the ease for attachment to a waist belt. The case is provided with an aperture 26 in an external surface 28 of a bottom wall of the case (best seen in FIGS. 2 and 4) through which fresh waste bags may be extracted, as will be described in greater detail subsequently.

Figure 7:
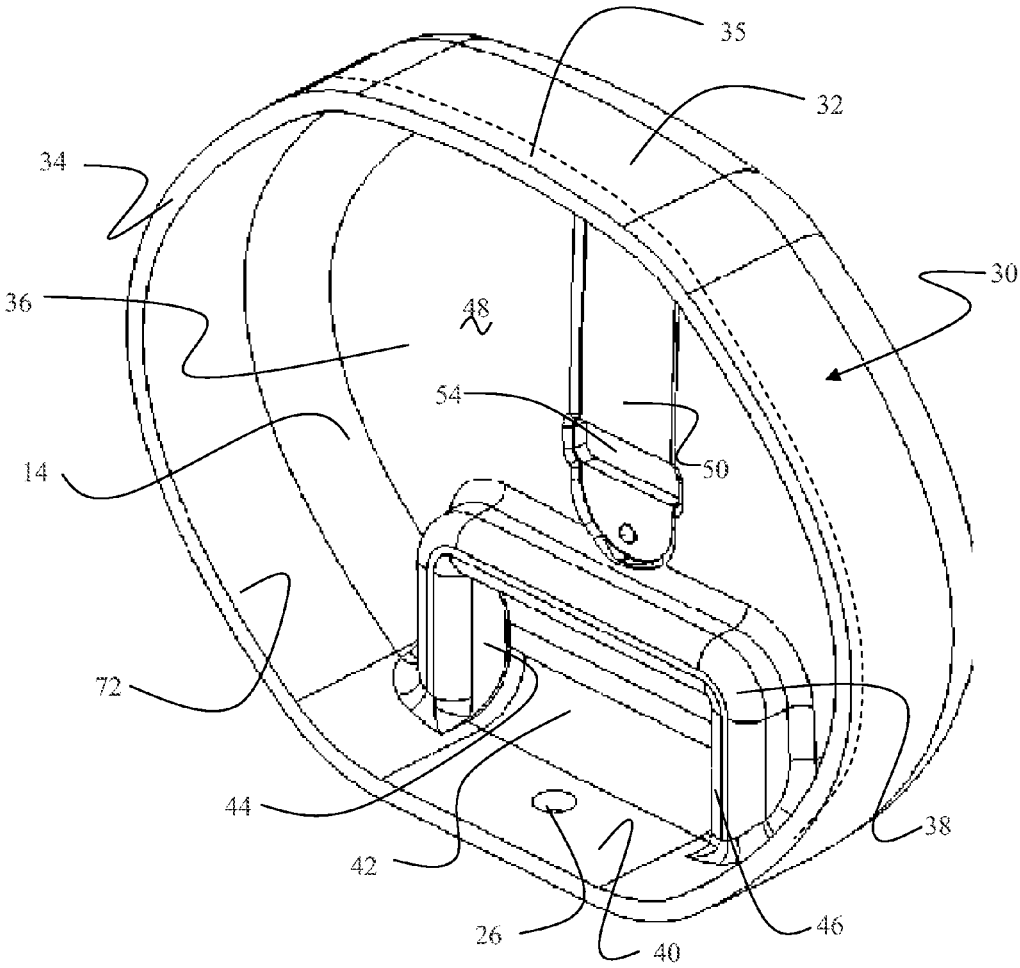
FIG. 7 is an front isometric view of a rear compartment molding 7 or the embodiment of FIG. 1.
Figure 8:
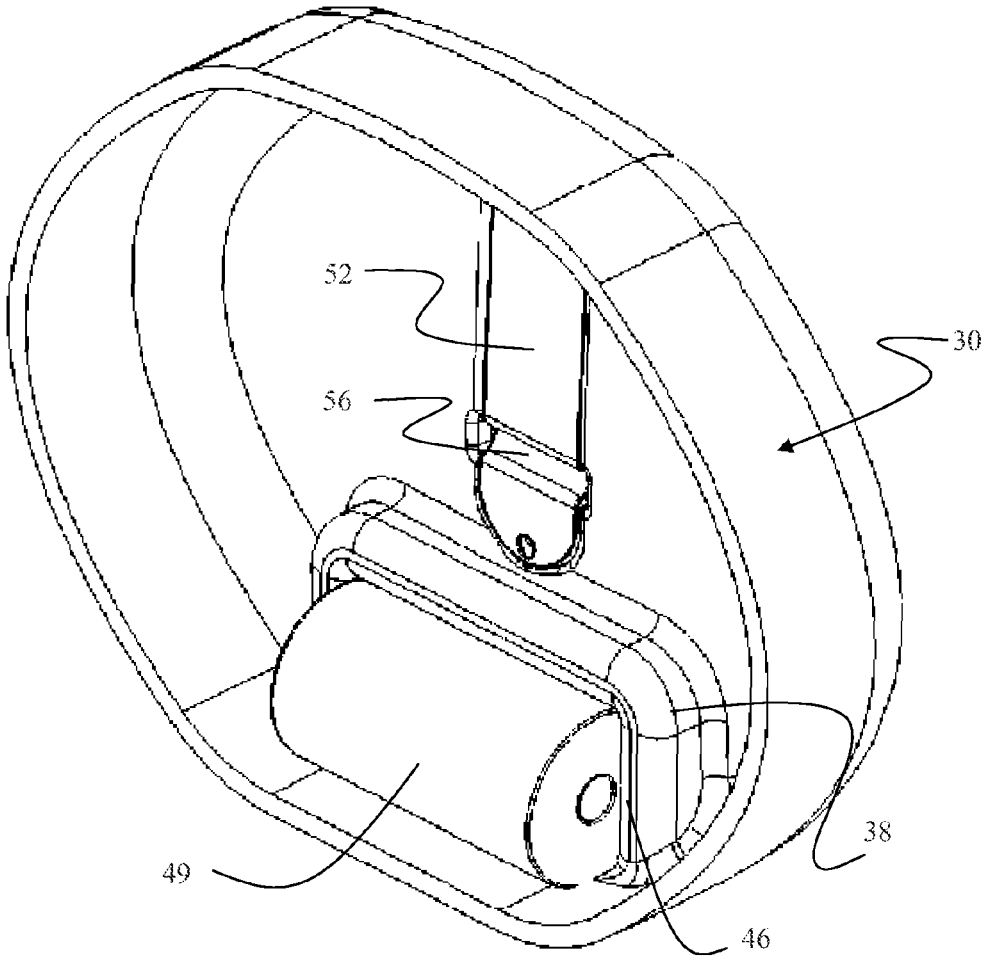
FIG. 8 is an front isometric view of the rear compartment molding with a waste bag roll belt clip inserted.
Figure 9:
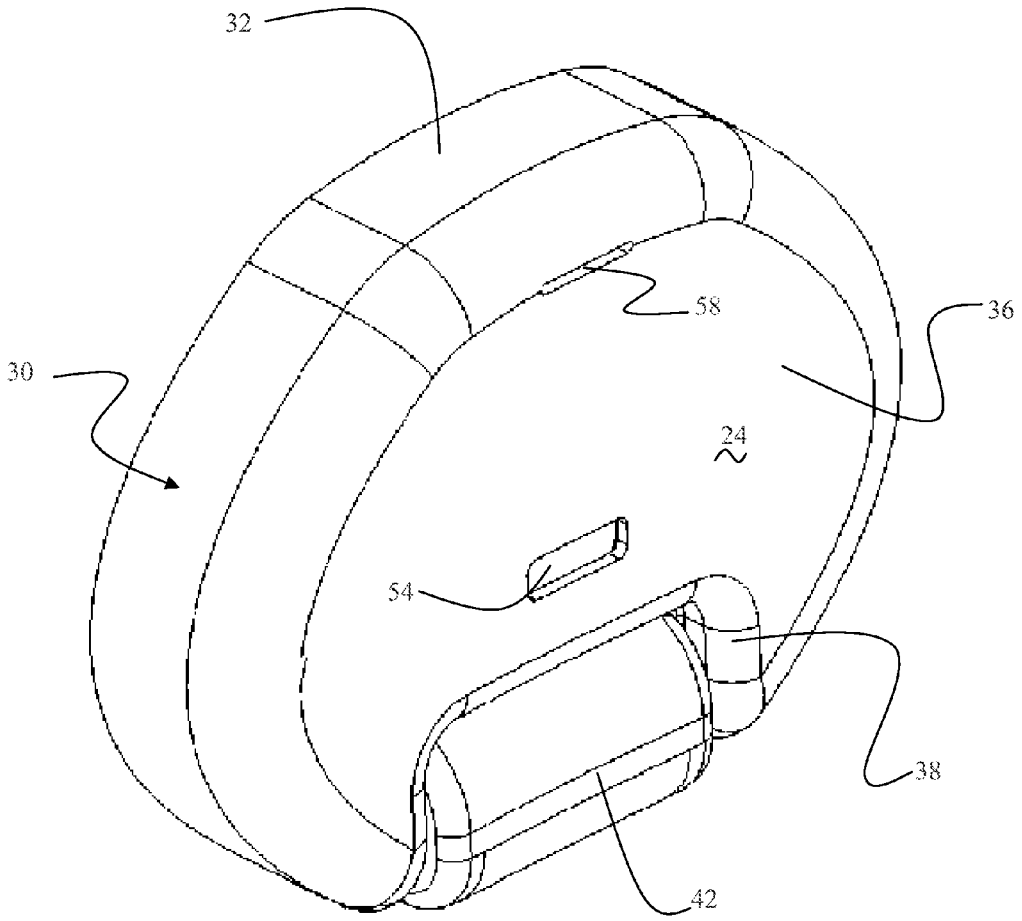
FIG. 9 is a rear isometric view of the rear compartment molding without the belt clip inserted.

FIGS. 7-9 show a rigid rear molding 30 which houses the rear compartment 14. The rear molding has a circumferential wall 32 with a front face 34. An attachment land 35 surrounds the front face on the wall for attachment of the rear moiety of zipper 12. Attachment of the zipper moieties described herein may be accomplished by sewing directly through the rigid foam of the moldings, sewing to a fabric covering, as will be described in greater detail subsequently, or sewing through both the foam and fabric. In the embodiment shown, the molding has a multisegmented ovaloid shape which is chamfered into a rear wall 36 having the external rear surface 24 (best seen in FIG. 9). The rear molding incorporates a rear moiety 38 of a waste bag roll containment which extends from the rear wall abutting a bottom wall 40 through which aperture 26 extends. The waste bag roll containment chamber has a substantially half cylinder wall 42 with flat opposing end surfaces 44 molded into the substantially rectangular engagement shape having a mating bead 46. As seen in FIG. 9, for the embodiment shown, the bag roll containment moiety shaping is thin wall or tight molded, as known to those skilled in the injection and vacuum molding arts, on the interior and exterior surface of the rear compartment molding 30 for reduced material usage. In alternative embodiments such tight molding may not be employed and a plain exterior surface presented on the external surface of the rear wall.

Rolls 49 of multiple fresh waste bags separated by serrations are inserted into the containment moiety 38 when the rear compartment is open. A bag end may then be inserted through aperture 26 to allow extraction of waste bags without opening the rear compartment, extracting and tearing off each bag as needed.

As shown in FIGS. 7 and 8, an interior surface 48 of rear wall 36 has a molded relief 50 to receive and secure an inner blade 52 (seen in FIG. 8) of belt clip 22. A rectangular aperture 54 in rear wall 36 extends from the relief to capture a rib 56 on the inner blade to secure the blade which is inserted through slot 58 in the chamfer on the top of rear wall 36. In the exemplary embodiment spring steel is employed for the belt clip which provides resilience to urge the inner blade into the relief and rectangular aperture on the interior surface 48 in opposition to the outer portion of the clip which reacts against the outer surface 24.

Figure 10:
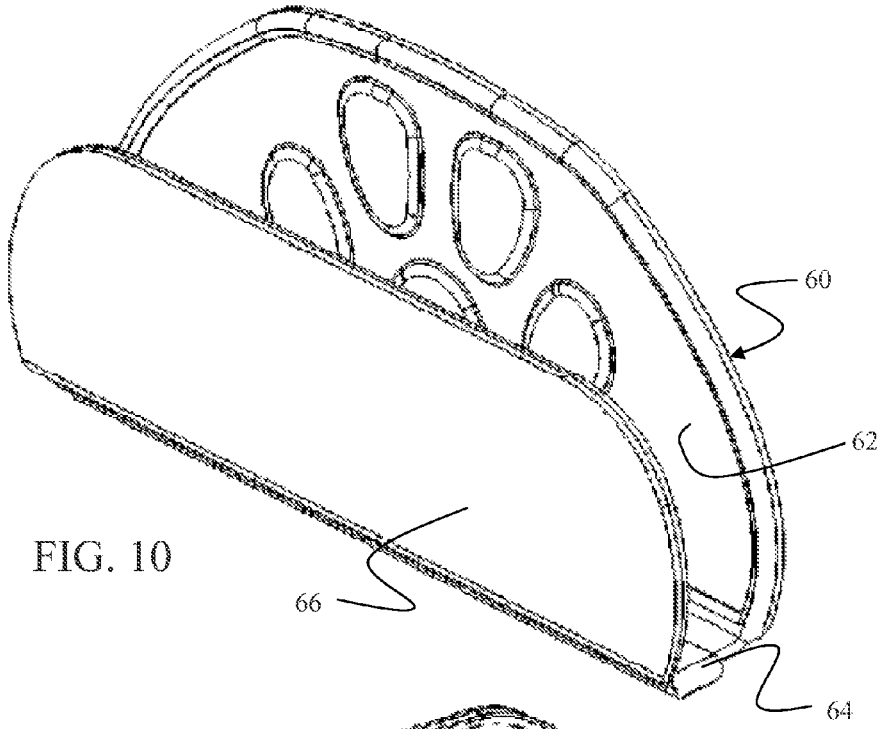
FIG. 10 is a front isometric view of an accessories shelf.
Figure 11:
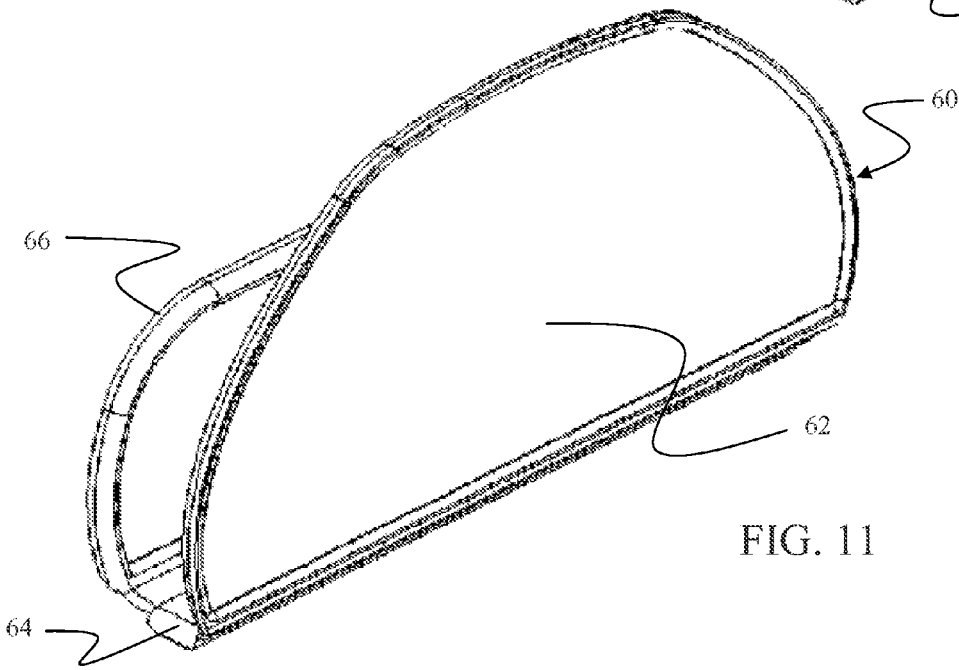
FIG. 11 is a rear isometric view of the accessories shelf.
Figure 12:
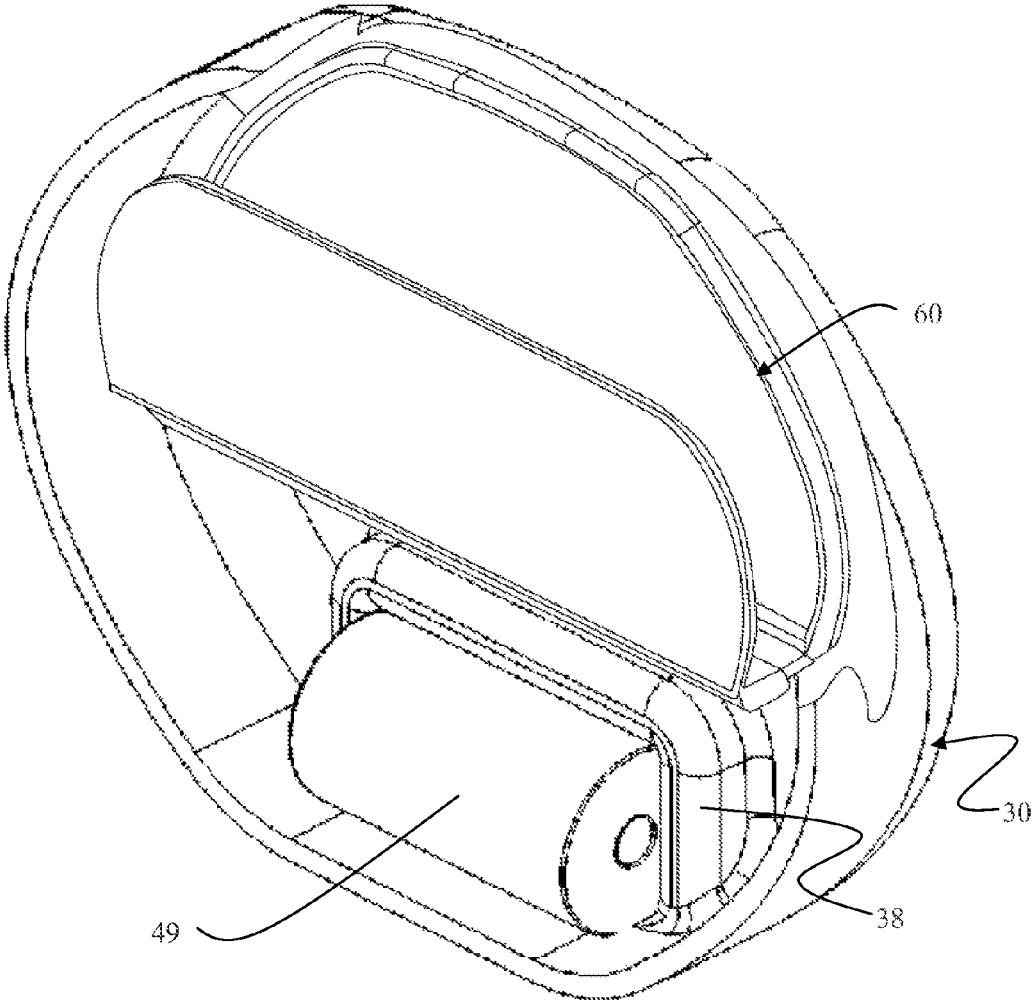
FIG. 12 is a front isometric partial cutaway view of the rear compartment molding with the accessories shelf installed.

For the exemplary embodiment, a personal accessories support shelf 60, shown in FIGS. 10 and 11, is secured to the rear interior surface 48 of the rear molding 30 for convenient organization of such items as cellular phones, money, identification and credit cards or other items. An upstanding rear flash 62 provides a surface for engagement of the rear interior surface 48 of the molding. In certain embodiments, the rear flash is adhesively bonded to the interior surface while in alternative embodiments, the flash is attached using hook and loop fasteners or similar removable securing means. A bottom 64 provides the segregating shelf for holding the personal items within the rear compartment and a forward flash 66 provides a restraining element to secure the items in the shelf when the rear compartment is opened. In the exemplary embodiment, the shelf is fabricated from resilient material bent or molded into the bottom and flashes to provide the desired flexibility. In alternative embodiments, a zipper or other closure between the flashes provides further security for the items held and, if removably secured by hook and loop fasteners or other means, provides a removable pouch for ease in organizing the personal items carried and shifting them to other containers such as a purse.

Figure 13:
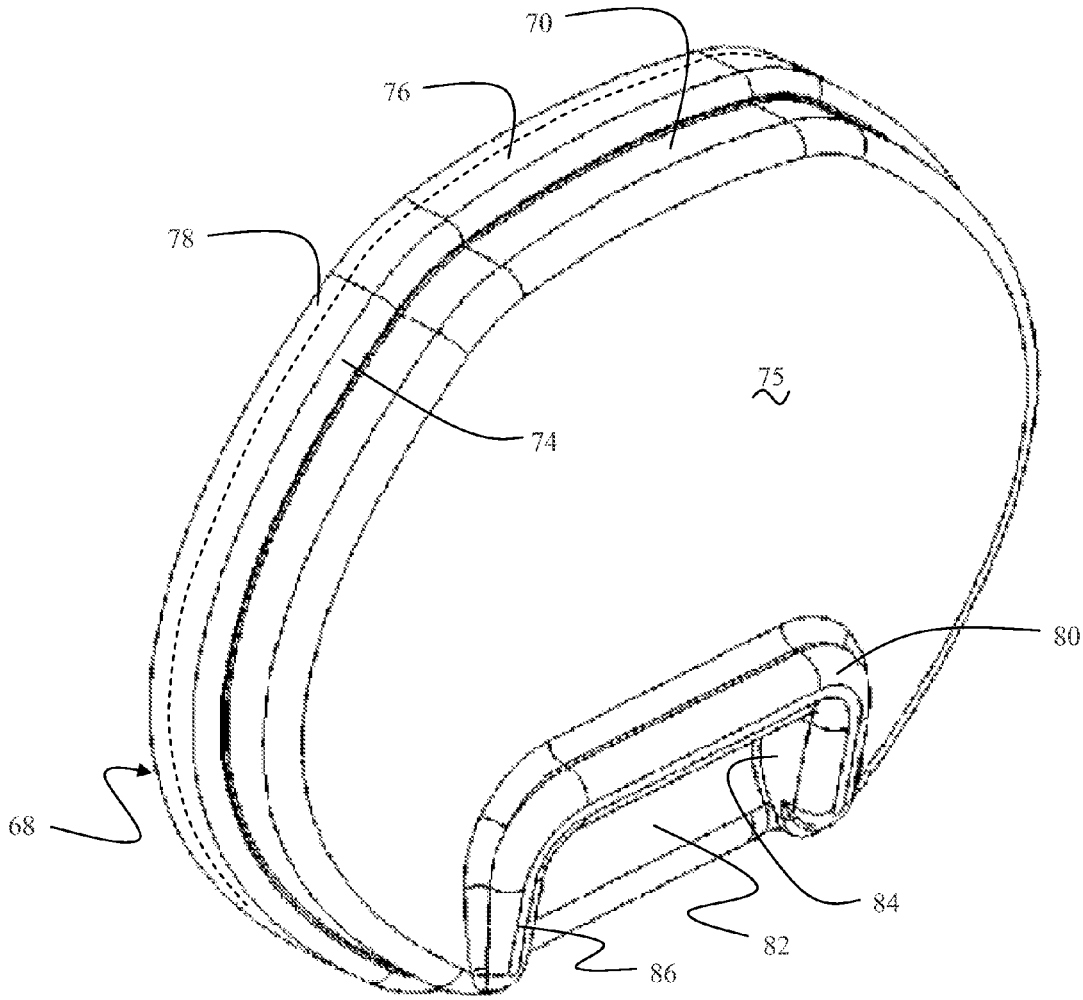
FIG. 13. is a rear isometric view of a center molding for the embodiment of FIG. 1.
Figure 14:
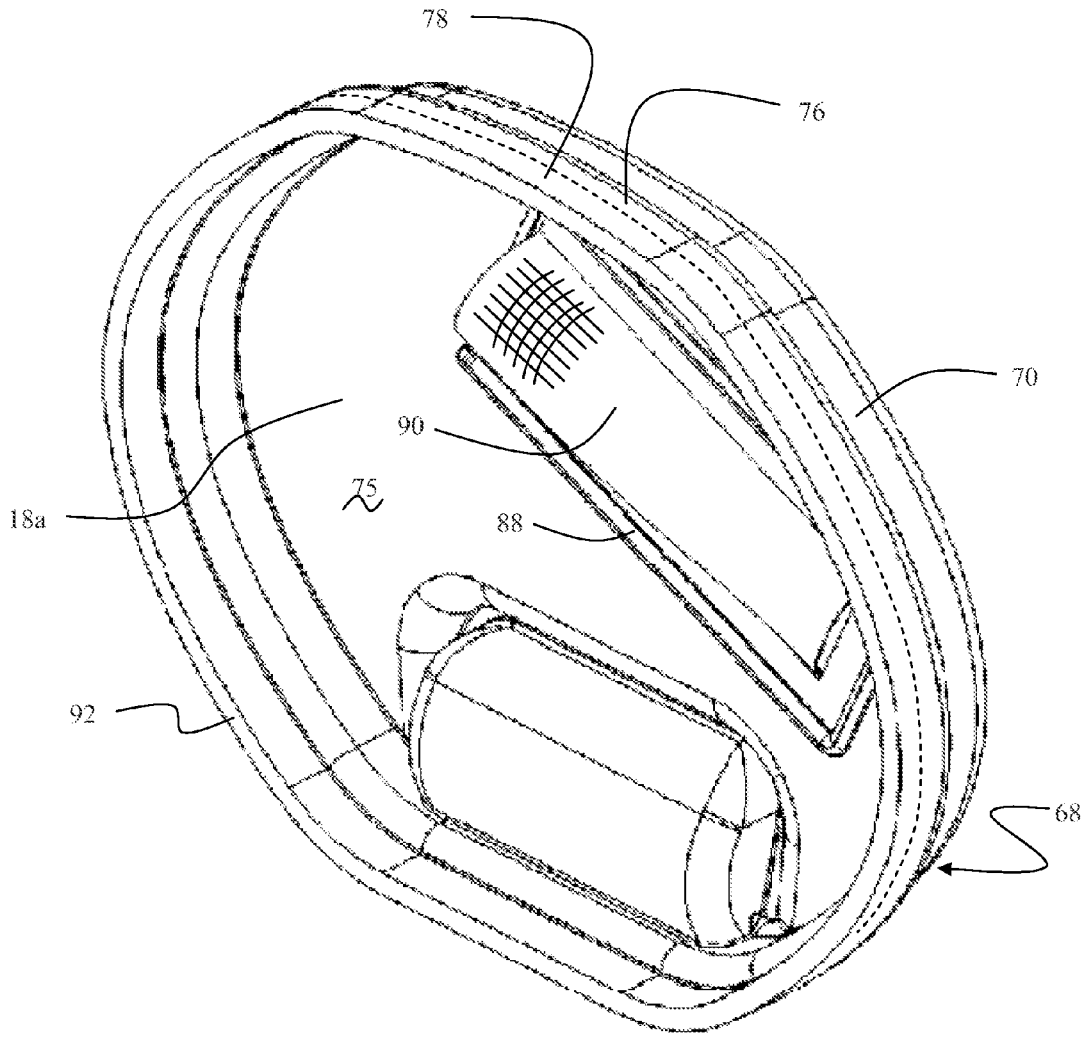
FIG. 14 is a front isometric view of the center molding.

A rigid center molding 68 shown in FIGS. 13 and 14 provides a divider for the front and rear compartments of the case. The center molding has a circumferential extrusion 70 which is shaped to be closely received within an inner lip 72 adjacent front face 34 of the rear molding. A mating face 74 surrounding the extrusion engages front face 34 on the rear molding for sealing engagement in the closed position and the extrusion includes a dividing wall 75 for the front and rear compartments. Attachment lands 76 and 78 provide surfaces for attachment of the front moiety of zipper 12 and the rear moiety of zipper 16. A mating front moiety 80 for the bag roll containment chamber has an opposing half cylinder wall 82 with opposing flat end surfaces 84 with a mating bead 86 to engage mating bead 46 on the rear moiety 38 and securely constrain bag rolls in the chamber with the rear compartment closed.

As shown in FIG. 14, the extrusion in the center molding provides substantial volume for a portion 18*a* of the front compartment. On a front surface of dividing wall 75 a capsule receiver 88 is provided hold an activated carbon capsule 90 for odor control in the front compartment which is employed for carrying used waste bags. A sealing surface 92 is provided around the circumference of the center molding adjacent attachment land 78 for the rear moiety of zipper 16. Accessibility of the front compartment through the front closing element, zipper 16, allows separate opening of the front compartment without accessing the rear compartment. Waste bags stored in the front compartment are therefore maintained completely segregated from the clean unused bags held in the bag roll containment chamber and the personal items carried in the rear compartment.

Figure 15:
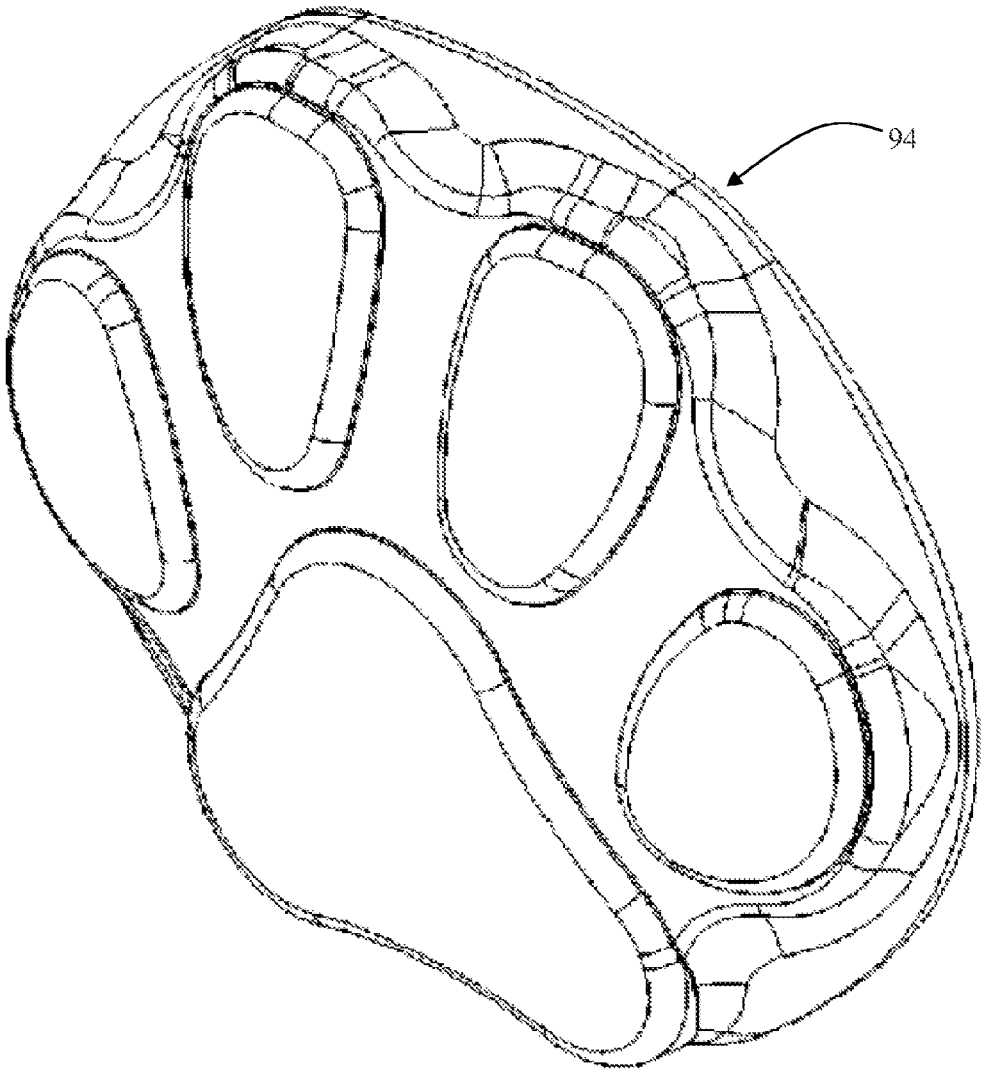
FIG. 15 is a front isometric view of a front molding for the embodiment of FIG. 1.
Figure 16:
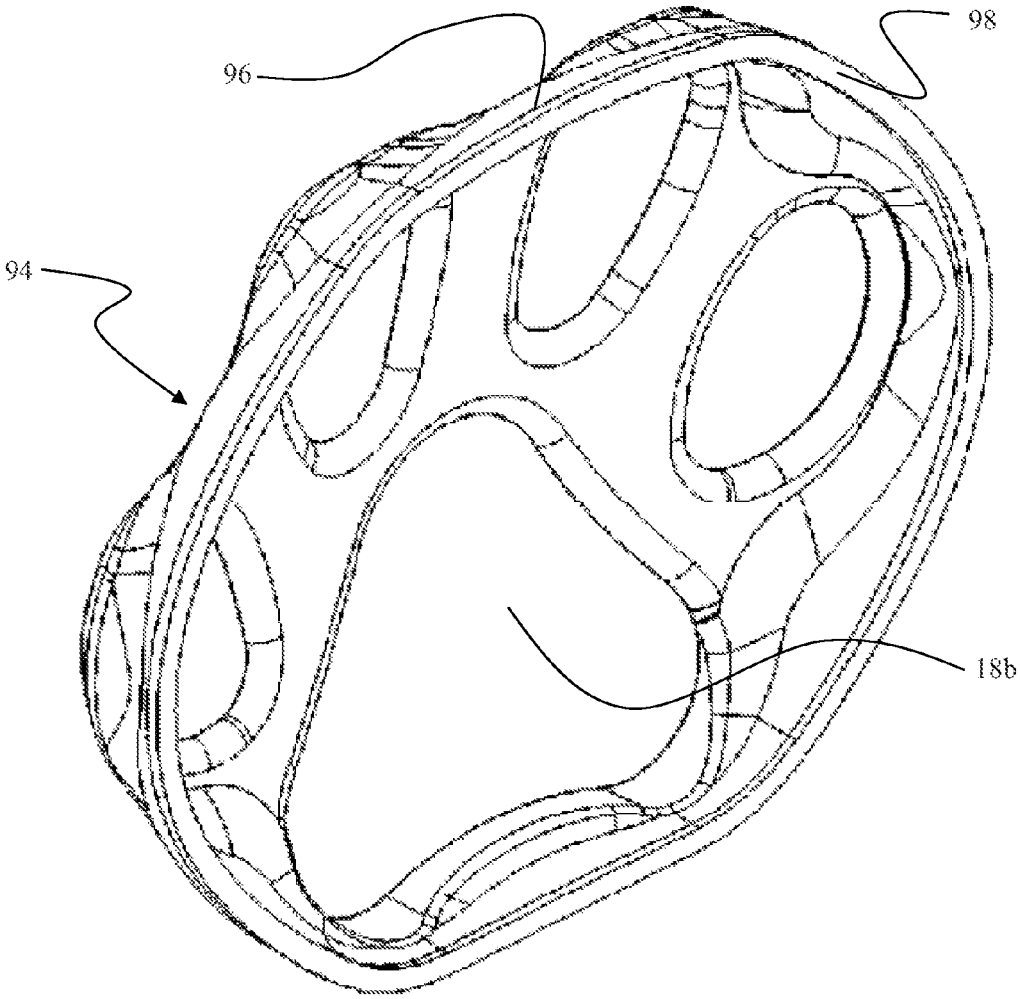
FIG. 16 is a rear isometric view of the front molding'

Closure of the front compartment is provided by a rigid front molding 94 which is shown in FIGS. 15 and 16. An attachment land 96 provided for attachment of the front moiety of zipper 16 and a sealing surface 98 surround the circumference of the front molding for mating engagement with the sealing surface 92 on the center molding. The molded shape of the front molding provides an additional portion 18*b* of the front compartment. The combined volume of portions 18*a* and 18*b* allow significant storage space for the used waste bags in the front compartment. The front molding is also amenable to embossment with artistic designs such as the puppy paw motif shown for the exemplary embodiment.

Figure 17:
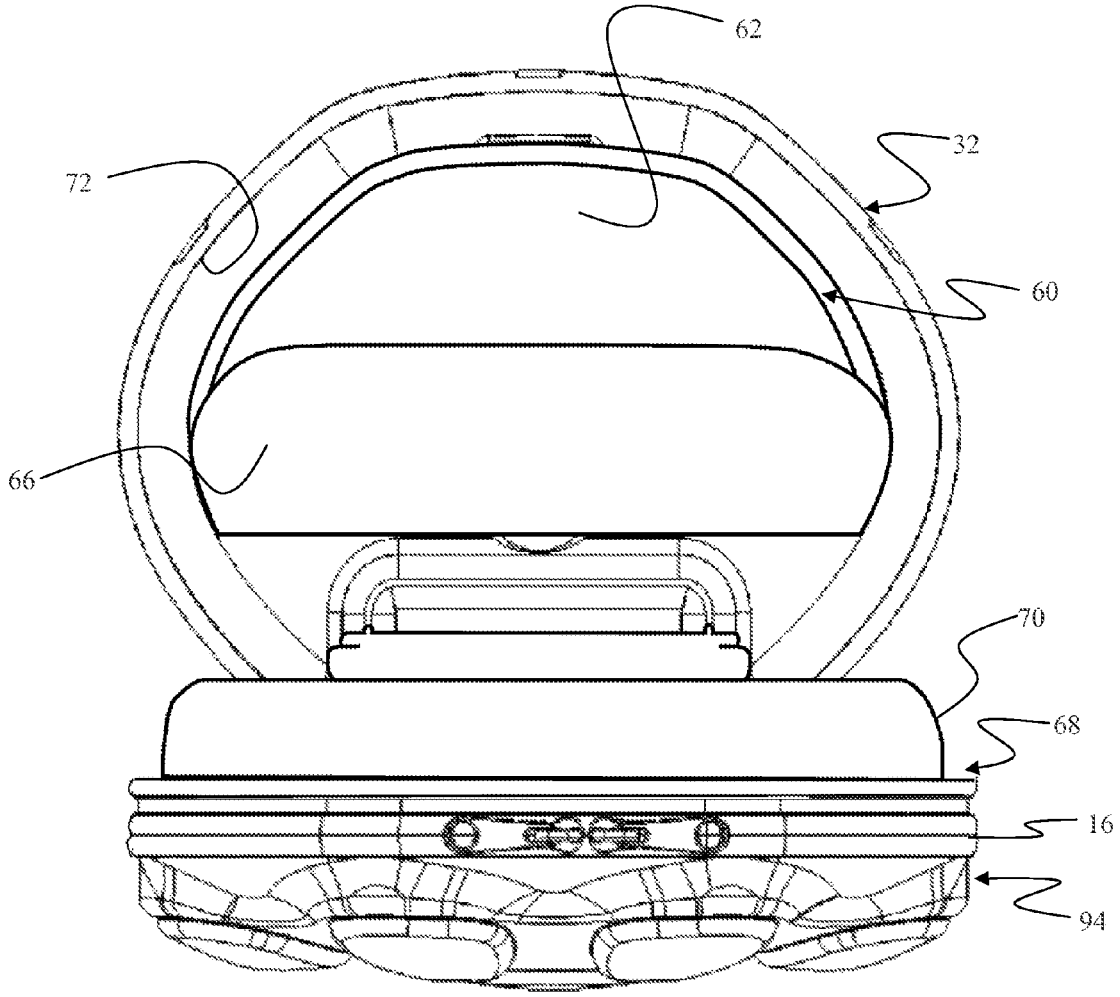
FIG. 17 is a front view of the embodiment of FIG. 1 with the accessories compartment open; and, FIG. 18 is a front view of the embodiment of FIG. 1 with the waste storage compartment open.

As shown in FIG. 17, the rear closure element, zipper 12, may be opened to allow access to the rear compartment to insert bag rolls or insert or retrieve personal items. Mating sealing surfaces 34 and 74 along with closely received extrusion 70 of the center molding resting in the lip 72 of the rear molding provides a sealed compartment for substantially preventing odor and bacterial contamination from being introduced from the front compartment providing a clean, sanitary storage compartment. With the rear compartment open, as shown, the accessories support shelf is easily accessed.

Figure 18:
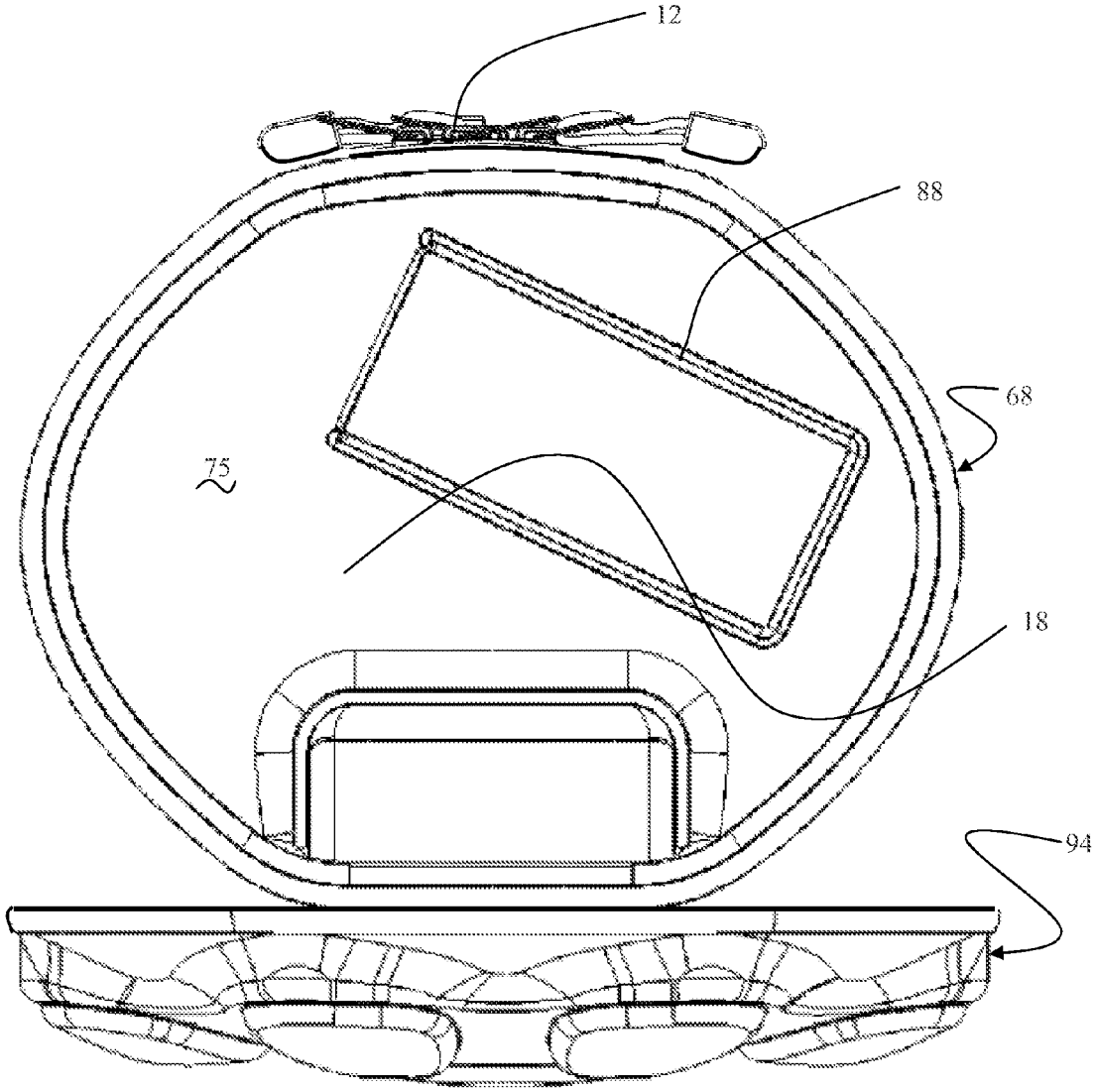

FIG. 18 shows the exemplary embodiment with the front closure element, zipper 16, open allowing access to the front compartment 18 for stowing or removing used pet waste bags or replacement of the activated carbon filter. The rigid structure of the front and center moldings prevent crushing which might tear or displace the stored used pet waste bags in a manner causing spillage.

For the exemplary embodiment, the front, center and rear moldings are made from high density, chemically cross-linked, closed cell rolled polyolefin foam which allows a tri-laminate thermoforming process and provides a moisture proof closed cell surface which resists bacterial absorption or odor permeation and is easily cleaned with soap and water. In certain embodiments, a fabric covering is laminated to or form fit around the exterior of the front, center and rear molding outer surfaces for enhanced aesthetic appearance and ease of attachment of the front and rear zipper moieties for the closure elements. Fabric covering of the interior surfaces of the moldings may also be accomplished for added texture and appearance in the front and rear compartments. In the exemplary embodiment, the capsule receiver 88 on the front surface of center wall 75 of the center molding employs a woven net or other fabric enclosure for the activated carbon capsule. While zippers have been shown as the front and rear closure elements in the exemplary embodiment, alternative closure devices such as hook and loop fasteners or molded snap arrangements intermediate the engaging surfaces may be employed. In the exemplary embodiment, hinging between the moldings is accomplished with either the fabric covering or closure moiety engagement. In alternative embodiments, molded hinge elements may be employed to secure the rear and center moldings and center and front moldings.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A pet waste disposal system comprising:

a rear molding having an interior volume for a rear compartment and including a bag roll containment chamber moiety adjacent an aperture in a bottom wall;

a center molding having an extrusion received in a circumferential lip of the rear molding in a closed position and a center wall, a bag roil containment chamber mating moiety extending from the center wail for engagement of the bag roll containment chamber moiety of the rear molding in the closed position, said extrusion housing a second interior volume for a portion of a forward compartment;

a front molding having a sealing surface to engage a front sealing surface on the center molding, said front molding closely received against the center molding in a closed position opposite the rear molding;

a first closure element releasably securing the rear molding and center molding in the closed position; and a second closure element releasably securing the center molding and front molding in the closed position.

2. The pet waste disposal system as defined in claim 1 wherein the bag roll containment chamber moiety has a molded half cylinder wall with opposing flat end walls and a surrounding first mating bead and the bag roll containment chamber mating moiety has an opposing molded half cylinder wall with opposing flat end walls and a surrounding second mating bead engaging the first mating bead in the closed position, said bag roll containment chamber moiety and mating moiety separable in an open position of the rear and center moldings to receive a bag roll, a free end of the bag roll received through the aperture in the bottom wall for external extraction of bags without opening the rear and center moldings.

3. The pet waste disposal system as defined in claim 1 further comprising:

a personal accessories support shelf engaged on a rear wall of the rear molding.

4. The pet waste disposal system as defined in claim 3 wherein the personal accessories support shelf incorporates a rear flash for engaging the rear wall, a bottom extending from the rear flash and terminating in a front flash, said rear flash, bottom and front flash resiliently interengaged.

5. The pet waste disposal system as defined in claim 4 wherein the rear flash is adhesively bonded to the rear wall.

6. The pet waste disposal system as defined in claim 4 wherein the rear flash and rear wall are interengaged with hook and loop fasteners.

7. The pet waste disposal system as defined in claim 1 wherein the first and second closure elements are zippers.

8. The pet waste disposal system as defined in claim 7 wherein a rear moiety of the first zipper is engaged on a first attachment land on a circumferential wall of the rear molding, a front moiety of the first zipper is engaged on a second attachment land on a circumferential wall of the center molding, a rear moiety of the second zipper is engaged on a third attachment land on the circumferential wall of the center molding immediately adjacent the second attachment land and a front moiety of the second zipper is engaged on a forth attachment land surrounding a circumference of the front molding.

9. The pet waste disposal system as defined in claim 1 further comprising a sealing face adjacent the circumferential lip on the rear molding and a mating sealing face surrounding the extrusion of the center molding, the sealing face and mating sealing face engaged in the closed position of the rear and center moldings.

10. The pet waste disposal system as defined in claim 1 further wherein a rear wall of the rear molding incorporates a relief in a front surface extending from a slot and further comprising a belt clip having a blade received through the slot and engaged in the relief, said belt clip extending over a rear surface of the rear wall for attachment to a user's belt.

11. The pet waste disposal system as defined in claim 10 wherein the relief incorporates a rectangular aperture engaging a rib on the blade to secure the belt clip.

12. The pet waste disposal system as defined in claim 1 wherein the rear, center and front molding are fabricated from closed cell reticulated foam.

13. The pet waste disposal system as defined in claim of claim 12 wherein the closed cell reticulated foam is high density, chemically cross-linked, closed cell rolled polyolefin foam.

14. The pet waste disposal system as defined in claim 1 wherein the rear, center and front moldings are fabric covered.

15. The pet waste disposal system as defined in claim 14 further comprising a plurality of strap attachments secured to the rear molding.

16. The pet waste disposal system as defined in claim 1 further comprising a capsule receiver for activated charcoal attached to a front surface of the center wall.

17. The pet waste disposal system as defined in claim 16 wherein the capsule receiver is a woven fabric.

18. The pet waste disposal system as defined in claim 1 wherein the front molding is embossed.

19. The pet waste disposal system as defined in claim 1 wherein the rear molding, center molding and front molding are multisegmented ovaloid shape.

20. A pet waste disposal system comprising:

a rear molding having an interior volume for a rear compartment and including a bag roll containment chamber moiety adjacent an aperture in a bottom wall, the bag roll containment chamber moiety having a molded half cylinder wall with opposing flat end walls and a surrounding first mating bead, a rear wail of the rear molding incorporating a relief in a front surface extending from a slot;

a belt clip having a blade received through the slot and engaged in the relief, said belt clip extending over a rear surface of the rear wail for attachment to a user's belt;

a personal accessories support shelf engaged on the rear wail of the rear molding and having a rear flash for engaging the rear wall, a bottom extending from the rear flash and terminating in a front flash, said rear flash, bottom and front flash resiliently interengaged;

a center molding having an extrusion received in a circumferential lip of the rear molding in a closed position and a center wall, said extrusion housing a second interior volume for a portion of a forward compartment, a bag roll containment chamber mating moiety extending from the center wall for engagement of the hag roll containment chamber moiety of the rear molding, the bag roll containment chamber mating moiety having an opposing molded half cylinder wall with opposing flat end walls and a surrounding second mating bead engaging the first mating bead in a closed position, said bag roll containment chamber moiety and mating moiety separable in an open position of the rear and center moldings to receive a bag roll, a free end of the bag roll received through the aperture in the bottom wall for external extraction of bags without opening the rear and center moldings in the closed position, a sealing face adjacent the circumferential lip on the rear molding and a mating sealing face surrounding the extrusion of the center molding engaged in the closed position of the rear and center moldings;

a capsule receiver of woven fabric for receiving activated charcoal attached to a front surface of the center wail;

an embossed front molding having a sealing surface to engage a front sealing surface on the center molding, said front molding closely received against the center molding in a closed position opposite the rear molding;

wherein the rear, center and front molding are fabricated from high density, chemically cross-linked, closed cell rolled polyolefin foam molded in multisegmented ovaloid shapes and the rear, center and front moldings are fabric covered with a plurality of strap attachments secured to the rear molding;

a first zipper releasably securing the rear molding and center molding in the closed position, a rear moiety of the first zipper engaged on a first attachment kind on a circumferential wall of the rear molding, a front moiety of the first zipper is engaged on a second attachment land on a circumferential wall of the center molding; and a second zipper releasably securing the center molding and front molding in the closed position, a rear moiety of the second zipper engaged on a third attachment land on the circumferential wall of the center molding immediately adjacent the second attachment land and a front moiety of the second zipper is engaged on a forth attachment land surrounding a circumference of the front molding, said moieties of said zippers engaged to the respective lands by sewing through the fabric and closed cell foam.

* * * * *